US006508039B2

(12) United States Patent
Gezelin

(10) Patent No.: US 6,508,039 B2
(45) Date of Patent: Jan. 21, 2003

(54) WINDOW SAFETY BARRIER

(76) Inventor: John J. Gezelin, 1405 Gordon Ave., Reno, NV (US) 89509

( * ) Notice: Subject to any disclaimer, the term of this patent is extended or adjusted under 35 U.S.C. 154(b) by 0 days.

(21) Appl. No.: 09/498,791

(22) Filed: Feb. 5, 2000

(65) Prior Publication Data

US 2002/0170247 A1 Nov. 21, 2002

(51) Int. Cl.[7] ..... E04B 1/38

(52) U.S. Cl. ..... 52/507; 49/55; 49/56; 49/57

(58) Field of Search ..... 49/50, 57, 55, 49/463, 61, 62; 52/507, 202

(56) References Cited

U.S. PATENT DOCUMENTS

| | | | | |
|---|---|---|---|---|
| 284,117 A | | 8/1883 | Byar | |
| 999,682 A | | 8/1911 | Suits | |
| 1,330,932 A | | 2/1920 | Bickerton | |
| 2,303,718 A | | 12/1942 | Becker et al. | |
| 4,263,747 A | * | 4/1981 | Coltrin et al. | 49/56 |
| 4,638,596 A | * | 1/1987 | Gallardo | 49/56 |
| 4,653,226 A | | 3/1987 | Woodrow | |
| 4,671,012 A | * | 6/1987 | Merlinger et al. | 49/55 |
| 4,756,122 A | | 7/1988 | Snapka | |
| 4,793,098 A | | 12/1988 | Wilkerson | |
| 4,848,030 A | * | 7/1989 | Bennett | 49/57 |
| 4,993,187 A | | 2/1991 | Schweiss | |
| 5,916,074 A | | 6/1999 | Tracy | |

* cited by examiner

*Primary Examiner*—Carl D. Friedman
*Assistant Examiner*—Steve Varner
(74) *Attorney, Agent, or Firm*—Patrick F. Bright

(57) ABSTRACT

A removable window safety barrier includes two vertical frame members, two horizontal frame members, and additional horizontal and vertical members attached to the horizontal and vertical frame members. The barrier includes at each end of the vertical frame members flanges having holes of suitable size and shape to engage and be supported by pins affixed to the sides of a window with two such pins pointing upwardly from the bottom of the window, and two such pins facing downwardly from the top of the window.

4 Claims, 2 Drawing Sheets

WINDOW SAFETY BARRIER

This invention relates to a removable window safety barrier. In preferred embodiments, this barrier includes two vertical frame members, one at a first end of the barrier, and one at a second end, joined together by two horizontal frame members at third and fourth ends. Each of the vertical frame members comprises a flat metal plate having a flange or a protrusion at each end of the vertical member. Each of these protrusions includes a hole of suitable size and shape to engage, and be supported by, a lag bolt, preferably an L-shaped lag bolt. The vertical members, in preferred embodiments, have a length in the range of about 2 to about 2.5 feet. The two horizontal frame members are metal bars made of four-sided, hollow, metal stock, preferably square metal stock. More preferably, the metal stock is half-inch square steel bars that are about 2.5 to about 3.0 feet in length.

In the preferred embodiment, the barrier also includes two, three or more additional horizontal members, with each horizontal member preferably made of the same metal stock as the two horizontal frame members. Preferably, the horizontal members are spaced nearly equal distances from one another.

The barrier may also include one or more additional vertical support members, each preferably attached to each of the horizontal members, by welding or otherwise. The horizontal members are joined to the vertical end members by welding, brazing, by hardware such as nuts and bolts, or otherwise.

The barrier is preferably installed in a window frame just above the window sill, and is positioned to prevent a small child from going through the window. The preferred embodiment is positioned in a window frame just above the sill on four lag bolts, two positioned near the bottom of the frame above the sill, and two near the top of the frame. These lag bolts preferably screw into, or otherwise penetrate securely into the window frame leaving, near the sill, two pins pointing upwardly from the plane of the window sill, one from each side of the frame. Near the top of the frame are two additional pins pointing downwardly toward the window sill, one from each side of the frame.

The barrier is removably mounted on the lag bolts by placing the holes of the barrier onto the downwardly-pointing pins, and moving the barrier upward until the holes at the bottom of the vertical members of the barrier are positioned over the upwardly-pointing pins. The holes at the bottom of each vertical member of the barrier are then seated on the upwardly-pointing pins, and the barrier is lowered to rest upon the two upwardly-pointing lag bolts.

BRIEF DESCRIPTION OF THE DRAWINGS

The invention can better be understood by reference to the drawings in which.

DESCRIPTION OF THE PREFERRED EMBODIMENTS

Figure 1:
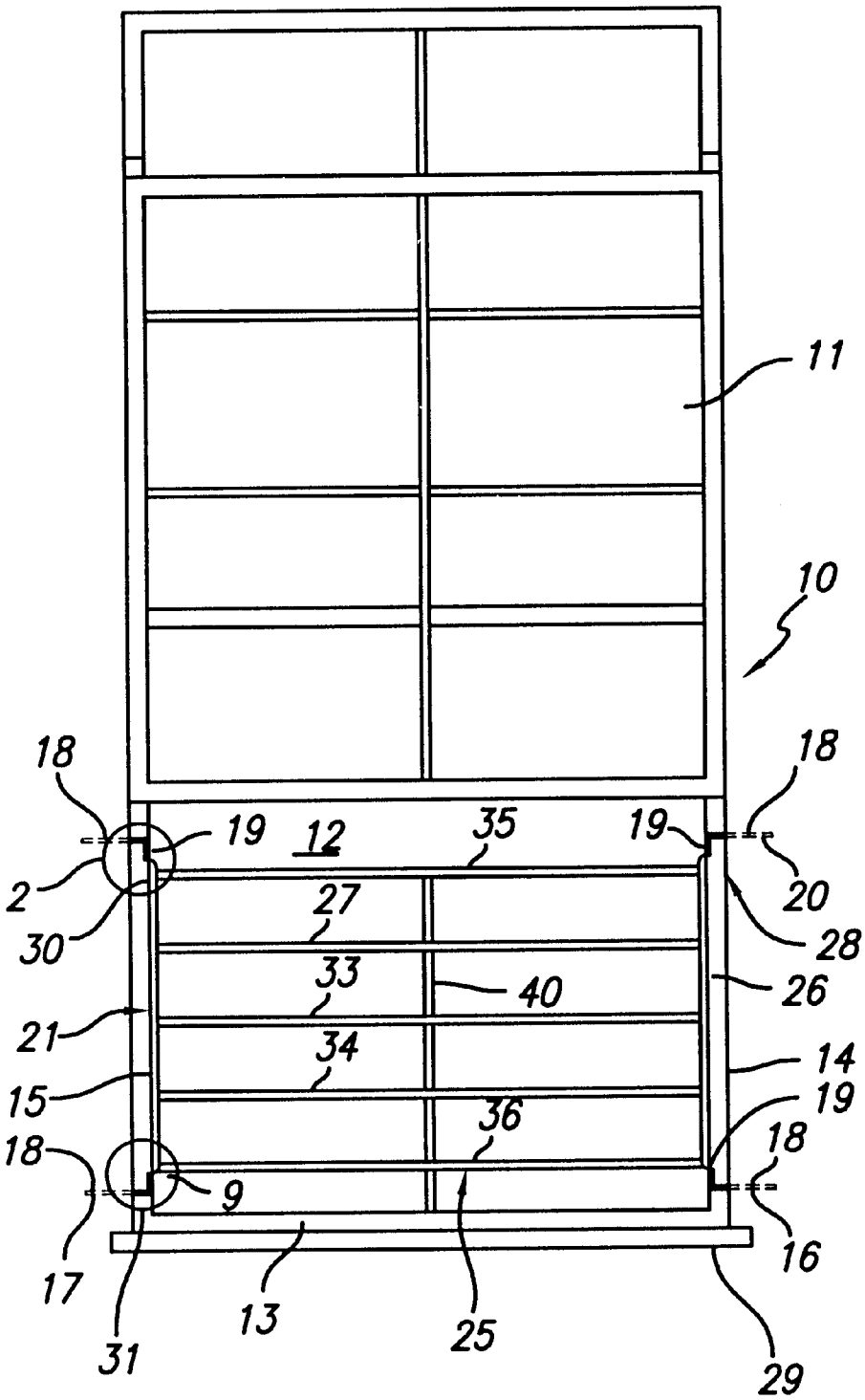
FIG. 1 shows an elevation view of a first embodiment of the barrier, removably seated in a window.

FIG. 1 shows window 10 with raised sash 11 having opening 12 above sill 13. Screwed into sides 14 and 15 of window 10 are L-shaped lag bolts 16 and 17. Each of lag bolts 16 and 17 includes a threaded shank 18 and integrally formed pin 19. Lag bolts 16 and 17 are screwed into side members 14 and 15 of window 10, such that pins 19 point upwardly from the plane of sill 13. Each of lag bolts 20 and 21 is screwed into window sides 14 and 15 with pins 19 pointing downwardly toward the plane of sill 13.

Inserted into opening 12 is barrier 25. Barrier 25 includes vertical frame members 26 and 27 made of flat metal stock. Vertical frame member 26 has, at its upper end, outwardly extending flange 28, and at its lower end, outwardly extending flange 29. Vertical frame member 27 has, at its upper end, outwardly extending flange 30, and at its lower end, outwardly extending flange 31. Each of flanges 28, 29, 30 and 31 has a round hole of a size and shape suitable to fit onto pins 19.

Barrier 25 also includes horizontal frame members 35 and 36, each welded to the inner surface of vertical frame member 27 at one end, and to the inner surface of vertical frame member 26 at the other end. Horizontal members 35 and 36 are made of square, hollow, steel bars. Also welded between the inner surface of vertical members 27 and 27 are horizontal members 37, 38 and 39. Horizontal members 36 and 29 are spaced apart about the same distance as horizontal members 38 and 39. Horizontal members 38 and 37 are spaced apart about the same distance as are members 37 and 35.

Frame 25 also includes an additional vertical member 40 made of the same square metal bar stock as frame numbers 35 and 36, welded midway between vertical frame members 27 and 26 to each of horizontal members 35, 37, 38, 39 and 36.

To remove barrier 25 from its position shown in FIG. 1, a user lifts barrier 25 upwardly until the holes in flanges 29 and 31 disengage from pins 19 on lag bolts 16 and 17. Barrier 25 is then moved toward, or away from, the plane of lag bolts 16 and 17, and is lowered until flanges 30 and 28 disengage from pins 19 on lag bolts 20 and 21.

Barrier 25 can be reinstalled by inserting the holes on flanges 30 and 28 onto pins 19 of lag bolts 20 and 21, and moving barrier 25 upwardly until the holes in flanges 29 and 31 are over the pins 19 on lag bolts 16 and 17. Barrier 25 is then lowered onto lag bolts 16 and 17, with pins 19 penetrating through the holes in flanges 31 and 29. In this way, barrier 25 can be positioned in window 10 to prevent small children from passing through window 10, but can easily be removed from inside or outside window 10 in case of fire or other emergency.

Figure 2:
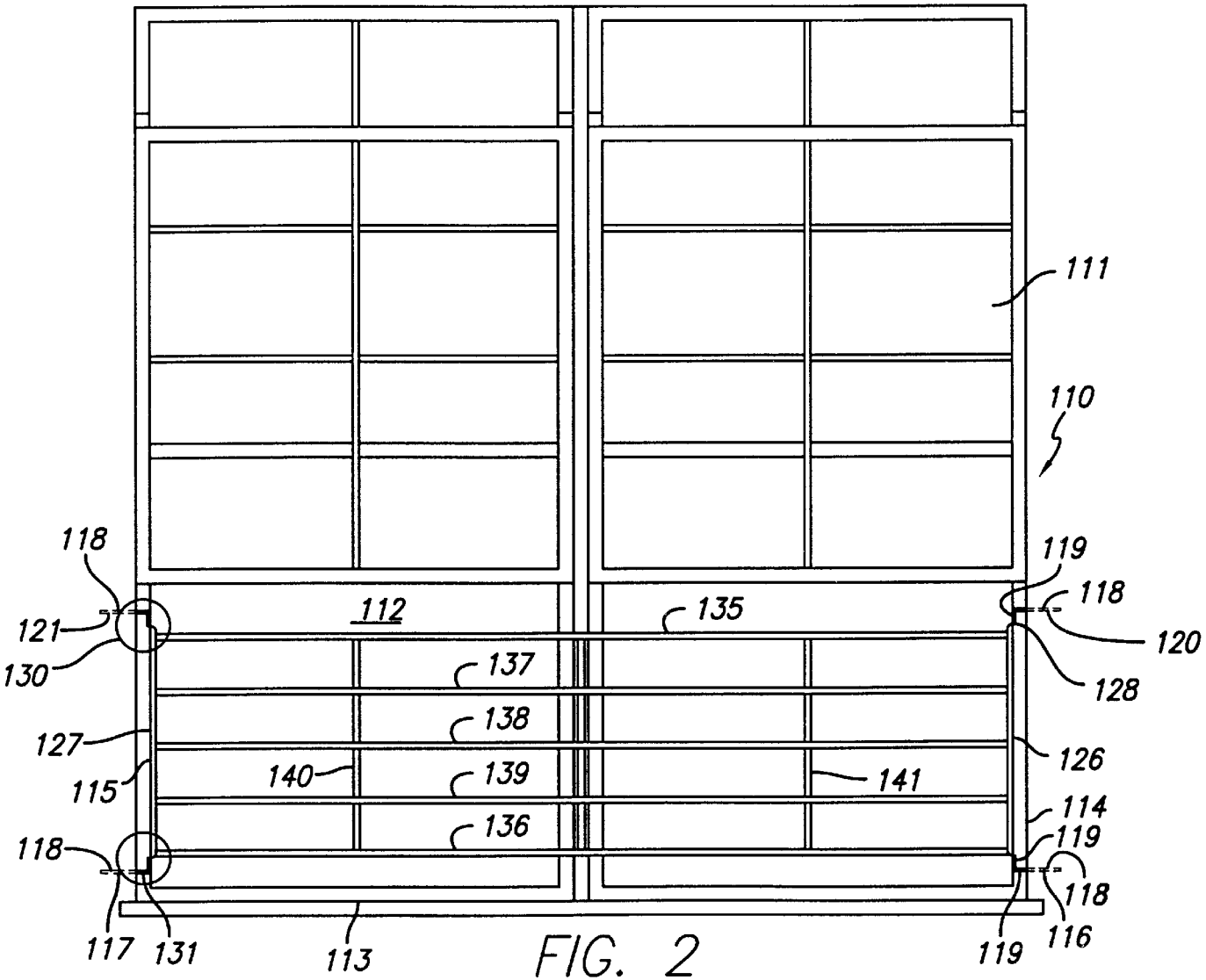
FIG. 2 shows an elevation view of a second embodiment of the barrier, removably seated in a window.

FIG. 2 shows window 110 with raised sash 111 having opening 112 above sill 113. Screwed into sides 114 and 115 of window 110 are L-shaped lag bolts 116 and 117. Each of lag bolts 116 and 117 includes a threaded shank 118 and integrally formed pin 119. Lag bolts 116 and 117 are screwed into side members 114 and 115 of window 110, such that pins 119 point upwardly from the plane of sill 113. Each of lag bolts 120 and 121 is screwed into window sides 114 and 115 with pins 119 pointing downwardly toward the plane of sill 113.

Inserted into opening 112 is barrier 125. Barrier 125 includes vertical frame members 126 and 127 made of flat metal stock. Vertical frame member 126 has, at its upper end, outwardly extending flange 128, and at its lower end, outwardly extending flange 129. Vertical frame member 127 has, at its upper end, outwardly extending flange 130, and at its lower end, outwardly extending flange 131. Each of flanges 128, 129, 130 and 131 has a round hole of a size and shape suitable to fit onto pins 119.

Barrier 125 also includes horizontal frame members 135 and 136, each welded to the inner surface of vertical frame member 127 at one end, and to the inner surface of vertical frame member 126 at the other end. Horizontal members 135 and 136 are made of square, hollow, steel bars. Also welded between the inner surface of vertical members 127 and 127 are horizontal members 137, 138 and 139. Horizontal members 136 and 129 are spaced apart about the same distance as horizontal members 138 and 139. Horizontal members 138 and 137 are spaced apart about the same distance as are members 137 and 135.

Frame 125 also includes two additional vertical members 140 made of the same square metal bar stock as frame numbers 135 and 136, welded between vertical frame members 127 and 126 to each of horizontal members 135, 137, 138, 139 and 136.

To remove barrier 125 from its position shown in FIG. 1, a user lifts barrier 125 upwardly until the holes in flanges 129 and 131 disengage from pins 119 on lag bolts 116 and 117. Barrier 125 is then moved toward, or away from, the plane of lag bolts 116 and 117, and is lowered until flanges 130 and 128 disengage from pins 119 on lag bolts 120 and 121.

Barrier 125 can be reinstalled by inserting the holes on flanges 130 and 128 onto pins 119 of lag bolts 120 and 121, and moving barrier 125 upwardly until the holes in flanges 129 and 131 are over the pins 119 on lag bolts 116 and 117. Barrier 125 is then lowered onto lag bolts 116 and 117, with pins 119 penetrating through the holes in flanges 131 and 129. In this way, barrier 125 can be positioned in window 110 to prevent small children from passing through window 110, but can easily be removed from inside or outside window 110 in case of fire or other emergency.

What is claimed is:

1. A removable window safety barrier comprises:

two vertical frame members, one at the first end of said barrier and the other at a second end of said barrier, joined together by two horizontal frame members at third and fourth ends of said barrier, said barrier including two or more additional horizontal members between said horizontal frame members to prevent passage through the frame by a person, and at least one additional vertical member attached to each of said horizontal members in said barrier, said barrier including, at each end of said vertical frame members, a flange having a hole of suitable size and shape to engage and be supported by pins affixed to the sides of a window, with two of said pins positioned near and pointing upwardly from the bottom of said window, and two other pins pointing downwardly toward said sill, said upwardly pointing and said downwardly pointing pins being spaced sufficiently far apart so that said barrier can be placed with its flanges at one end of said vertical members on the downwardly pointing pins and the holes in the other end of said vertical members seated on the pins projecting upwardly from said window sill, said barrier being removably mounted on, and removably disengaged from said pins, whereby said barrier is completely removable from the outside of or from the inside of said window.

2. The barrier of claim 1 wherein said vertical frame members are flat metal pieces, and said horizontal frame members are hollow metal bars.

3. A removable window safety barrier comprises:

two vertical frame members and two horizontal frame members, with additional horizontal members and vertical members drawing said frame members to one another, said barrier including, at each end of said vertical frame members, a flange having a hole of a suitable size and shape to engage and be supported by pins affixed to the sides of a window, with two of said pins positioned near and pointing upwardly from the bottom of said window and two other pins pointing downwardly toward the bottom of said window, said barrier being removably mounted on said pins with the flanges at one end of said vertical frame member engaging the downwardly pointing pins and the flanges at the other end of said barrier engaging the two upwardly pointing pins, said barrier being removably mounted on, and removably disengaged from said pins, whereby said barrier is completely removable from the outside of or from the inside of said window.

4. The barrier of claim 3 wherein said vertical frame members are flat metal pieces, and said horizontal frame members are hollow metal bars.

* * * * *